United States Patent [19]

Trümper

[11] 4,449,364

[45] May 22, 1984

[54] SLUING DRIVE FOR EXCAVATOR

[75] Inventor: Reinhard Trümper, Offendorf, Fed. Rep. of Germany

[73] Assignee: O & K Orenstein & Koppel AG, Fed. Rep. of Germany

[21] Appl. No.: 342,142

[22] Filed: Jan. 25, 1982

[30] Foreign Application Priority Data

Jan. 27, 1981 [DE] Fed. Rep. of Germany ..... 3102532

[51] Int. Cl.[3] ..... F16D 31/02

[52] U.S. Cl. ..... 60/403; 60/425; 60/484; 91/509

[58] Field of Search ..... 60/420, 423, 425, 426, 60/484, 403; 91/509, 510, 514, 516; 414/687, 744 R

[56] References Cited

U.S. PATENT DOCUMENTS 3,662,550 5/1972 Lichtfuss ..... 60/425 X 3,768,263 10/1973 Olson et al. ..... 60/425

3,868,062 2/1975 Cunningham et al. ..... 60/403 X

*Primary Examiner*—Edward K. Look

*Attorney, Agent, or Firm*—McGlew and Tuttle

[57] ABSTRACT

A sluing mechanism driven by one or more electric or hydraulic motors, for excavating or bulk handling machines comprises a pivotable discharger boom mounted on a rotary support or turntable, and a coaxially pivotable superstructure carrying further equipment. The sluing drives of the two coaxially pivotable parts of the machine are connected to each other in such a way that upon pivoting the superstructure, the discharger boom does not follow this pivotal motion. The sluing drive of the discharge boom is designed as a superposed gear and connected to a drive motor for separately sluing the discharger boom. The turntable is provided with a second discharger sluing gear which is driven by a motor having a weaker characteristic than the drive motor or motors for sluing the superstructure. The characteristic of the motor driving the second discharger sluing gear may be adjustable.

14 Claims, 6 Drawing Figures

SLUING DRIVE FOR EXCAVATOR

FIELD AND BACKGROUND OF THE INVENTION

The present invention relates in general to sluing gear arrangements and in particular to a new and useful sluing drive for excavators having a pivotable superstructure and a pivotable discharge boom.

Excavating or bulk handling machines are known which utilize sluing mechanisms that are driven by one or more drive motors. Such machines include discharge boom assemblies which are mounted on rotary supports that are coaxial with rotatable superstructures. The superstructures carry the rotary support as well as other equipment. Sluing drives of the rotary support and the superstructure are connected to each other so that the superstructure and discharge boom can be pivoted separately.

Such machines have the advantage that upon sluing the superstructure and the equipment, for example digging means supported in the superstructure, the discharger boom does not change its position. This facilitates the operation of the machine. On the other hand, the discharger boom can be slued independently of the superstructure. In prior art excavating or bulk handling machines, the respective sluing gears are positively engaged. This positive engagement can be provided only at a single location between the gear rim of the sluing gear of the discharger boom and the main sluing gear of the superstructure, which is disadvantageous. Upon a failure in this positive engagement due to a shaft fracture, tooth breakage, and the like, the discharger boom is no longer retained by the discharger sluing gear and may accidentally change its position due to wind pressure or tilt of the machine. When this happens the boom may hit other parts of the superstructure and destroy the machine.

SUMMARY OF THE INVENTION

An objective of the present invention is to eliminate said disadvantages of the prior art, and to provide a sluing mechanism of the above-mentioned kind by which the discharger boom is firmly and safely retained in its position even upon a destruction of the positive engagement or failure in the connection between the sluing gear of the superstructure and the sluing gear of the discharger boom. Free uncontrollable motion for example under wind pressure or a tilted position, which might result in major damage, is thus prevented.

In accordance with the invention, a turntable of the device is provided with a second sluing gear for the discharger boom, having a drive motor with a weaker characteristic than the drive motor or motors for sluing the superstructure. A sluing gear for the discharger boom is obtained which is hydraulically or electrically connected to, and driven by, the main sluing gear. In addition, a mechanism is obtained which becomes effective as soon as the sluing gear for the discharger boom, coupled to the main sluing gear, fails and no longer transmits any torque to the discharger boom. In such a case, the second sluing gear takes up the load and prevents a possible destruction of the machine.

According to a development of the invention, the characteristic of the drive motor for the second sluing gear of the discharger boom may be adjustable. Due to such a provision, the idle run otherwise present in normal operation of the second discharger boom sluing gear which is not positively engaged, is eliminated. A drive motor with an adjustable characteristic rather operates to the effect that any load compensation can be adjusted, so that the discharger boom sluing drive serving so to speak as a safety device, can also participate in the drive of the discharger sluing gear. The characteristics of the drive motors of the main sluing gear and the discharger boom sluing gear may be brought into such relation that an adjustable load is produced for the drive of the main sluing gear at the discharger boom sluing gear.

The drive motors may be electric motors or hydraulic motors.

With a hydraulically driven inventive sluing gear, the following further advantages may be obtained:

Since in normal operation, the hydraulic drive of the discharger boom runs, through the positively connected discharge sluing gear, in synchronism with the drives of the main sluing gear, the adjustment of a definite motor characteristic prevents uncontrollable reactive forces. Upon a failure of the positively engaged discharger boom sluing gear, the mechanism prevents the discharger boom from an uncontrollable behavior.

Accordingly an object of the present invention is to provide a sluing device for a machine having a carriage, a turntable rotatable about an axis to the carriage, a superstructure connected to the turntable and a discharge boom assembly rotatably mounted to the carriage about the axis, comprising, first drive means having at least one drive motor connected between the carriage and turntable to rotate the turntable, second drive means having at least one drive motor connected between the turntable and discharge boom assembly for rotating the discharge boom assembly, said first and second drive means connected to each other so that rotation of the turntable with respect to the carriage in one direction causes rotation of the discharge boom assembly in an opposite direction, so that the superstructure moves alone with respect to the carriage, and further drive means having at least one motor connected between the turntable and discharge boom assembly, said further drive means motor having a weaker drive characteristic than that of said first drive means motor.

A further object of the invention is to provide adjustment means for said further discharge means motor to adjust the drive characteristic thereof.

A still further object of the invention is to provide each of the drive means with hydraulic drive motors.

A still further object of the invention is to provide a sluing device for such machines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
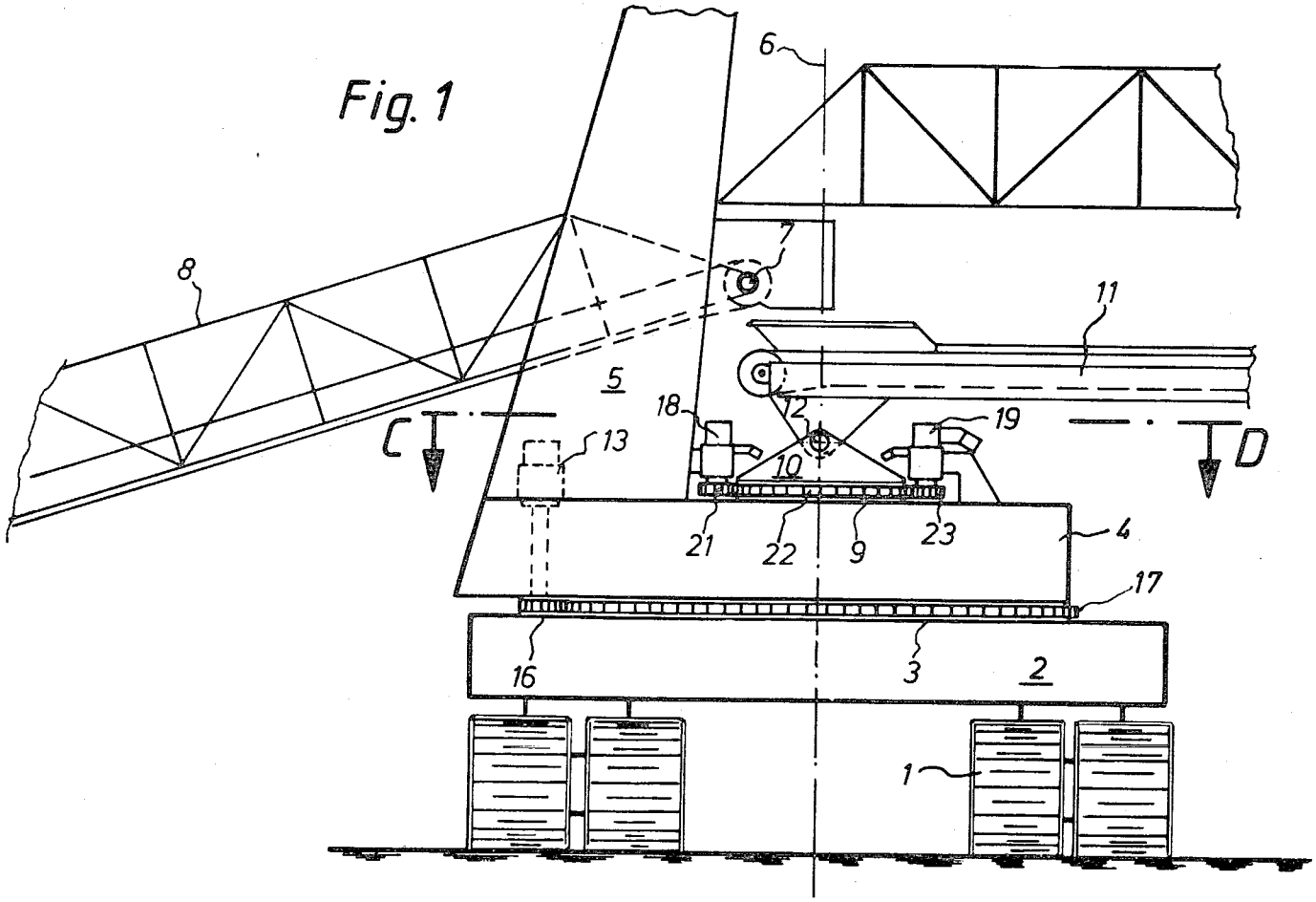
FIG. 1 is a partial side elevational view of an excavator.

Referring to the drawings in particular, the invention embodied therein comprises a sluing device for a machine having a carriage 2 which rotatably carries a turntable 4 which itself rotatably carries a discharge boom assembly having discharge turntable 10. Turntable 4 and discharger turntable 10 are coaxially rotatable about substantially vertical axis 6.

The excavator comprises a crawler gear 1 and undercarriage 3 supporting, through a ball bearing sluing gear 2, turntable 4 of the superstructure 5 which is pivotable about vertical axis 6. A take-up boom 8 of a head part (not shown) of the excavator is hinged to superstructure 5 for pivoting about a horizontal axis 7 and carries, on its free other end, digging equipment, for example (not shown). On top of turntable 4, a discharger boom 11 is mounted through another ball bearing sluing gear 9 and discharger turntable 10, also for pivoting about vertical axis 6. For lifting and lowering its free other end by means of a hoisting device (not shown), boom 11 is hinged to turntable 10, by a pivot pin 12 extending horizontally through vertical axis 6. Superstructure 5 is pivotable about its vertical axis 6 by means of three main sluing gears 13, 14, 15 which are driven by motors 24, 25, 26 and include pinions which engage a gear rim 17 secured to undercarriage 2.

Figure 2:
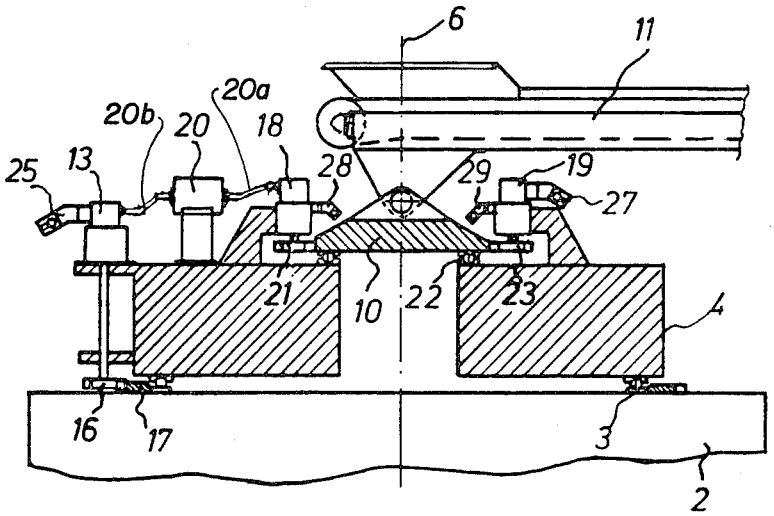
FIG. 2 is a sectional view taken along the line A–B of FIG. 3.
Figure 3:
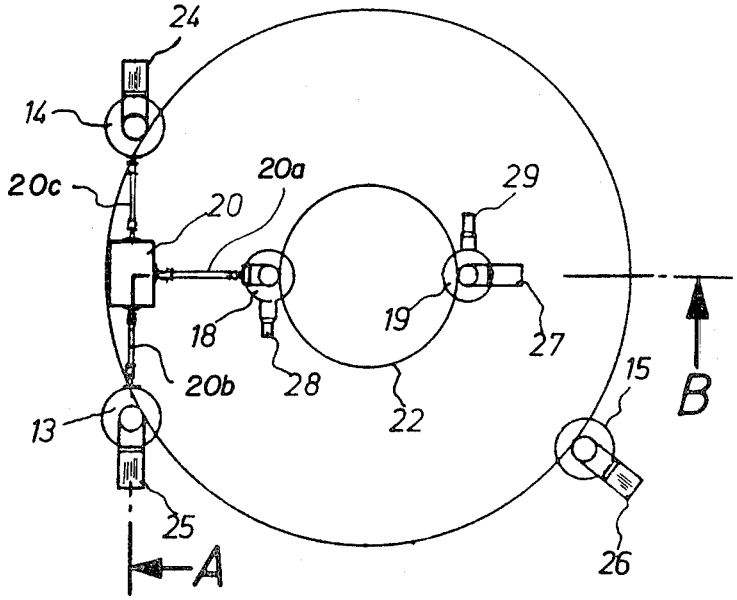
FIG. 3 is a sectional view taken along the line C–D of FIG. 1.

In FIGS. 1 and 2, only one of the pinions, namely pinion 16 of main sluing gear 13, is shown. Turntable 4 carries a discharger boom sluing gear 18 which is coupled, through a differential gear 20 and universal shafts 20*a*, 20*b* and 20*c*, to main sluing gears 13 and 14. A pinion 21 of discharger boom sluing gear 18 meshes with a gear rim 22 secured to discharger turntable 10.

In the course of excavation, superstructure 5 carrying takeup boom 8 is moved in pivotal motion about vertical axis 6 by means of the three main sluing gears 13, 14, 15. During this pivoting motion, discharger boom 11 and discharger turntable 10 remain fixed relative to undercarriage 2 and crawler gear 1. This is obtained by means of discharger sluing gear 18 by which discharger turntable 10 is turned relative to turntable 4 in the opposite direction through exactly the same angle through which turntable 4 is turned relative to undercarriage 2, so that the resulting differential angle of rotation between turntable 10 and undercarriage 2 is zero.

To operate the discharging belt carried by discharger boom 11 it is necessary to pivot boom 11 in certain time intervals about its vertical axis 6. A possibility must be given to do this independently of the rotation of turntable 4. To this end, a drive motor 28 is provided which operates on discharger boom sluing gear 18 designed as a superposed gear, and with which discharger boom 11 can be pivoted relative to undercarriage 2. This customary combination of discharger boom sluing gear 18 with main sluing gears 13, 14 is a positive connection between discharger turntable 10 and undercarriage 2. The operation of the excavator requires a positive connection between undercarriage 2 and discharge turntable 10. Upon a failure, such a breakage in discharger sluing gear 18, differential gear 20, pinion 21 or another part producing the positive connection between main sluing gears 13, 14 and discharger turntable 10, a holding force can no longer be exerted on discharger turntable 10. If the excavator occupies a tilted position and a force resulting therefrom acts on discharger boom 11, or if boom 11 is under a wind pressure, boom 11 and discharger turntable 10 are set in an uncontrollable motion until the boom collides with superstructure 5. This may destroy discharger boom 11 and, in particularly unfavorable circumstances, even the entire excavator.

To avoid such hazards and other disadvantages, a second discharger sluing gear 19 is provided on turntable 4 in addition, which may be of identical design with discharger sluing gear 18. This second gear is driven by a motor 27 whose speed is equal to the speed of the universal shaft 20*a* at discharger sluing gear 18. To avoid static indeterminacy, load balancing is provided which may be effected in various ways.

For example, drive motor 27 may have a weaker characteristic (e.g. torque) than drive motors 24, 25. This produces the effect that under regular conditions, the motor transmits only a small torque. However, in case of a failure of discharger sluing gear 18, discharger sluing gear 19 takes up the force transmission to discharger turntable 10, and thus forestalls the risk of destroying the machine.

Another way is to design drive motor 27 with an adjustable characteristic. Then the load balance can be adjusted so that during the sluing operation the two discharger sluing gears 18, 19 transmit mutually equal torques.

An additional motor 28 may be connected to discharger sluing gear 18, and an additional motor 29 to discharger sluing gear 19. Under normal operating conditions, additional motor 28 may effect the sluing of discharger boom 11, along with additional motor 29. With a failure of force transmission through discharger sluing gear 18, discharger sluing gear 19 and motor 29 can not only safely hold discharger turntable 10 in position but also change the position of the discharger boom 11 through motor 29, and control this position for a certain time so accurately that the machine can continue to operate correctly.

As already mentioned, both electric or hydraulic drive motors 24, 25, 26, 27 may be employed. What is important is to employ a motor 27 having a weaker characteristic than motors 24, 25, 26 which otherwise are of identical design, or a motor 27 whose characteristic is adjustable for proper operation.

In the following, some hydraulic drives are explained with reference to FIGS. 4 to 6, where similar parts are designated with similar numerals.

The hydraulic system comprises one or more hydraulic pumps 30 which are driven by an electric motor or internal combustion engine (diesel) in each case.

Figure 4:
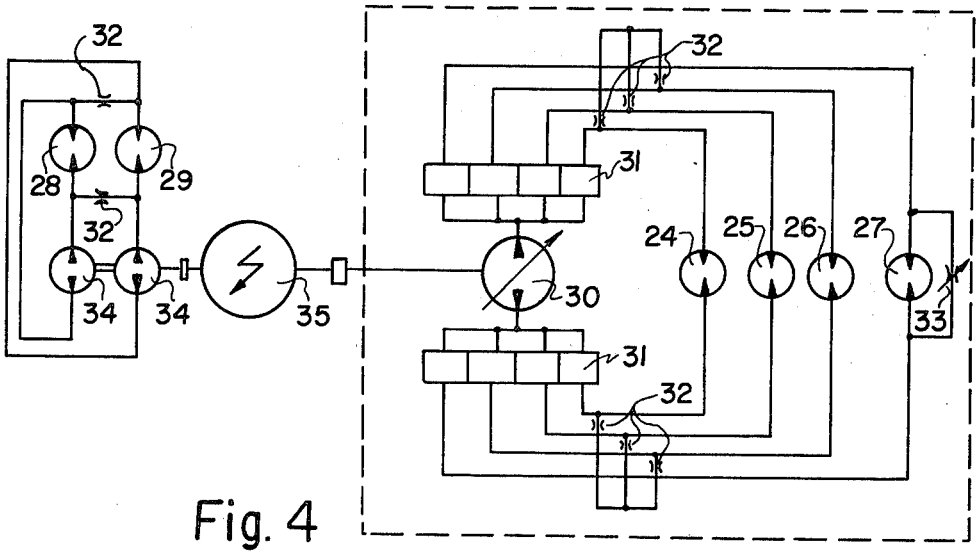
FIGS. 4 to 6 are several circuit diagrams of a hydraulic drive.
Figure 5:
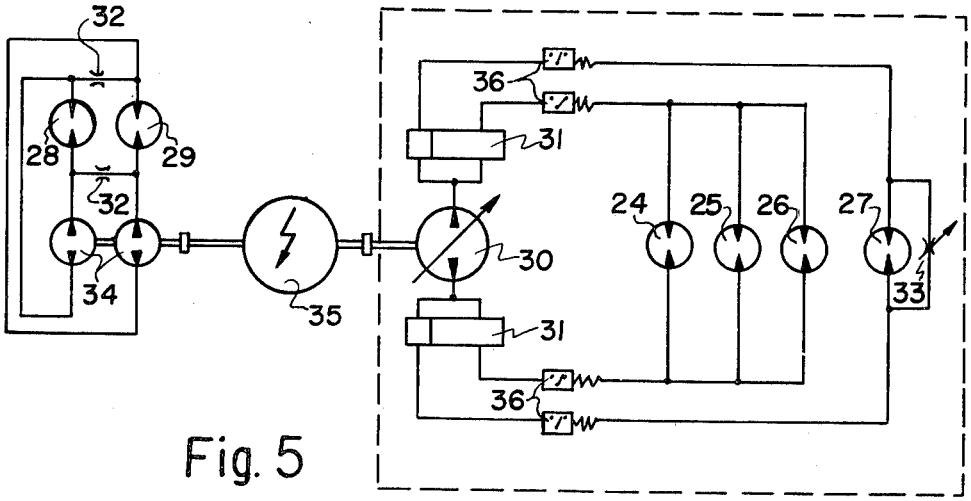

In the embodiment of FIGS. 4 and 5, a flow divider 31 is connected in the line leading to drive motors 24 to 27, by which the rates of flow of the oil are adjusted to synchronize the drive motors. Flow divider 31 ensures that upon a line breakage at one of the drive motors, the pressure and speed are reduced also for the other drive motors.

Figure 6:
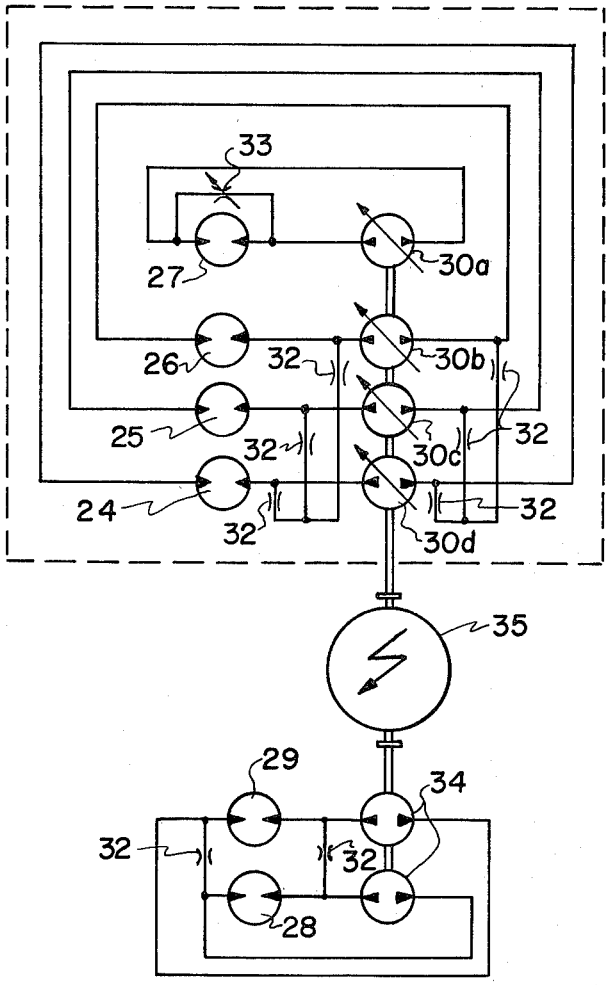

The pressure lines are connected to each other through mutualy communicating throttles 32 in FIGS. 4 and 6.

One throttle 33 is connected parallel to drive motor 27 of discharger sluing gear 19. This throttle may have a variable cross-section which is so dimensioned that drive motor 27 idles along without load. Throttle 33 may be adjustable, however, so that drive motor 27 has a variable characteristic and operates with a variable proportional load. This is the same for the devices of FIGS. 4, 5 and 6.

The system operates in a closed cycle in both directions, wherefore the needed throttles 32 and flow dividers 31 are provided at both sides of hydraulic pumps 30. Further features, like a cooler, feed pump, etc., corresponding to standard equipment have been omitted for clarity and are considered known per se.

Since in normal operation, hydraulic drive motor 27 of discharger sluing gear 19, due to the positively connected drive of discharger sluing gear 18, runs in synchronism with drive motors 24, 25, 26 of the main sluing gear, the occurrence of reactive forces is prevented by the adjustment of a definite characteristic of the motor. Upon a failure of positively connected discharger sluing gear 18, the system prevents an uncontrolled behavior of the discharger sluing gear and produces the effect that the discharger sluing gear, now driven through discharger sluing gear 19, continues to run at a speed corresponding to the basis of the preceding speed minus the speed variation caused by slippage. Thus, aside from negligible deviations which may be controlled by additional motor 29, the discharger boom will keep its initial position and a risk of destruction will be avoided.

In the shown embodiment, additional motors 28, 29 for the discharger sluing gears are supplied by separate hydraulic pumps 34 which also are connected to electric motor 35.

FIG. 5 shows an embodiment in which pressure safety switches 36 are provided in the pressure lines instead of throttles 32, to stop the pivotal motion upon an undue pressure drop caused by failure in the hydraulic system.

FIG. 6 shows a circuit for providing a plurality of hydraulic pumps 30*a*, 30*b*, 30*c*, 30*d* driven at equal speeds. Each of the pumps is connected to one of drive motors 24 to 27.

Again, mutually communicating throttles 32 are connected in the pressure lines by hydraulic pumps 30*a* to 30*b*. The design of the throttles is identical to that of the embodiment of FIG. 4.

In another embodiment, the individual motors or their volumetric efficiency may be used for performing the function of the throttles.

It is also possible to allow the oil to flow out of the closed circuit, thus to omit a closed circuit.

An electrical system of driving the inventive sluing mechanism is designed basically in a similar way. Drive motors 24 to 27 are synchronized in accordance with the shown hydraulic system. Main sluing gears 13, 14, 15 are equipped with drive motors 24, 25, 26 having a normal characteristic, while discharger sluing gear 19 is driven by a motor 27 having a fixed, weaker characteristic than motors 24, 25, 26. Instead of a drive motor with a fixed weaker characteristic, a drive motor with an adjustable weak characteristic may be employed. The operation of an electrically driven mechanism is the same as described in connection with a hydraulic drive.

While specific embodiments of the invention have been shown and described in detail to illustrate the application of the principles of the invention, it will be understood that the invention may be embodied otherwise without departing from such principles.

What is claimed is:

1. A sluing device for a machine having a carriage, a turntable rotatable about an axis to the carriage, a superstructure connected to the turntable, and a discharge boom assembly rotatably mounted to the turntable about the axis, comprising:

first drive means having at least one drive motor connected between the carriage and turntable for rotating the turntable;

second drive means connected between the turntable and boom assembly for driving the boom assembly, said first and second drive means connected to each other so that rotation of the turntable with respect to the carriage in one direction causes rotation of the boom assembly in an opposite direction by an amount to maintain a position of the boom assembly with respect to the carriage as the superstructure rotates with respect to the carriage; and further drive means having a drive motor connected between the turntable and boom assembly for maintaining engagement between the turntable and boom assembly with failure of said second drive means, said further drive means motor providing a torque which is less than that provided by said at least one first drive means motor.

2. A sluing device according to claim 1, including adjustment means in said further drive means for adjusting the drive characteristic of said further drive means motor.

3. A sluing device according to claim 1, wherein said second drive means includes an additional motor for rotating said boom assembly independently of said first drive means.

4. A sluing device rccording to claim 1, wherein said further drive means includes an additional motor for rotating said boom assembly independently of said first mentioned further drive means motor.

5. A sluing device according to claim 1, wherein each of said first and further drive means motors comprises a hydraulic motor.

6. A sluing device according to claim 5, including a single hydraulic pump connected to said hydraulic motors for driving each of said hydraulic motors, a flow divider connected between said hydraulic pump and said hydraulic motors for dividing fluid from said hydraulic pump among said hydraulic motors and an adjustable throttle connected in parallel to the hydraulic motor forming said further drive means motor.

7. A sluing device according to claim 5, wherein said first drive means comprises a plurality of drive motors each being a hydraulic motor, a fluid line connected between said flow divider and each first drive means hydraulic motor and a throttle connected to each hydraulic line, each throttle of said hydraulic lines connected to each other throttle of said hydraulic lines.

8. A sluing device according to claim 5, including a pressure safety switch connected between said flow divider and each hydraulic motor for cutting off fluid flow to each hydraulic motor upon pressure drop in fluid supplied to each hydraulic motor respectively.

9. A sluing device according to claim 5, wherein each hydraulic motor has two inputs for driving each hydraulic motor in opposite directions, said hydraulic pump having two outputs for supplying fluid to said two inputs of said hydraulic motors respectively and a flow divider between each pump output and each respective hydraulic motor input for dividing fluid among said hydraulic motors and whereby each hydraulic motor can be operated in both directions.

10. A sluing device according to claim 1, wherein each first drive means and further drive means motors comprise a hydraulic motor and a separate hydraulic pump connected to each hydraulic motor, and hydraulic pump connected to a common electric motor and having means for adjusting the output of each hydraulic pump respectively.

11. A sluing device according to claim 10, wherein said first drive means includes a plurality of drive motors each formed by a hydraulic motor, a hydraulic pump for each first drive means hydraulic motor, at least one hydraulic line connected between each hydraulic pump and its respective first drive means hydraulic motor, a throttle connected to each hydraulic line and each throttle of each hydraulic line connected to each other throttle of each hydraulic line.

12. A sluing device according to claims 3 or 4, wherein each drive motor comprises a hydraulic motor, at least one hydraulic pump connected to said hydraulic motors, a single electric motor connected to said at least one hydraulic pump for driving said hydraulic pump and at least one additional hydraulic pump connected to said one electric motor and to said additional drive motor for driving said additional drive motor.

13. A sluing device according to claim 1, wherein said first drive means includes a plurality of drive motors each formed by a separate hydraulic pump having equal drive characteristics, said further drive means motor comprising a hydraulic pump having a drive characteristic which is weaker than that of each one of said first drive means hydraulic motors.

14. A sluing device according to claim 13, including a transmission connected between at least one of said first drive means hydraulic motors and said second drive means.

* * * * *